United States Patent [19]

Dufour

[11] 4,360,311

[45] Nov. 23, 1982

[54] PUBLIC WORKS MACHINE, SUCH AS A HYDRAULIC SELF-PROPELLED ARTICULATED SHOVEL

[76] Inventor: Serge Dufour, Rue du Clos Joli, F01300 Belley, France

[21] Appl. No.: 189,842

[22] Filed: Oct. 22, 1979

[51] Int. Cl.[3] ..... E02F 9/08; B62D 25/00

[52] U.S. Cl. ..... 414/687; 414/694; 180/41

[58] Field of Search ..... 180/41; 280/6 H, 43.22, 280/43.24; 414/685, 694, 687; 212/189

[56] References Cited

U.S. PATENT DOCUMENTS

| | | | |
|---|---|---|---|
| 3,235,280 | 2/1966 | Moustgaard | 414/694 X |
| 3,430,790 | 3/1969 | Beltrami | 180/41 |
| 3,499,559 | 3/1970 | Pederson | 414/694 |
| 3,635,364 | 1/1972 | Tingleff | 414/694 |
| 3,807,586 | 4/1974 | Holopainen | 414/694 |
| 3,924,704 | 12/1975 | Lindblom | 180/41 |

*Primary Examiner*—Robert J. Spar
*Assistant Examiner*—Terrance L. Siemens
*Attorney, Agent, or Firm*—Young & Thompson

[57] ABSTRACT

This invention relates to a public works machine such as a self-propelled hydraulic shovel. This machine comprises a lower chassis provided toward one end with a pair of carrying wheels mounted on wheel-carrying arms that may be adjusted and raised, and toward the other end with raisable stabilizers. A superstructure is mounted on this lower chassis by a positioning ring. The superstructure carries, on the one hand, working equipment of the machine and, on the other hand, a pair of carrying wheels mounted on raisable arms. The control of the machine is effected by pivoting of the two parts about the positioning ring. This machine permits travelling on uneven ground while the machine remains level.

10 Claims, 9 Drawing Figures

PUBLIC WORKS MACHINE, SUCH AS A HYDRAULIC SELF-PROPELLED ARTICULATED SHOVEL

The present invention relates generally to public works machines such as hydraulic shovels.

Known self-propelled hydraulic shovels ordinarily comprise a rigid chassis provided with four wheels, of which at least two are driven, and on which are secured one or two pairs of stabilizers. This chassis is surmounted by a positionable superstructure to one end of which is pivoted a working device.

A drawback of these machines resides in the fact that they are not all well adapted for travelling on rough terrain, by virtue of their low clearance and the low angles at which they may be withdrawn resulting from the presence of the stabilizers. Also, the movement on sloping terrain in a direction perpendicular to the slope of the terrain is limited to small inclinations, as one rapidly reaches the limit of lateral swinging of the machine. Still further, it is impossible to dig an upright trench perpendicular to the direction of the slope by virtue of the short adjustability of the stabilizers or wheels, which do not permit leveling the machine.

According to another known construction, the wheels are mounted on pivotal arms and the machine comprises a frame provided with cross beams at its ends and on which it rests when working, by raising the wheel-bearing arms. The frame has at its center a positioning ring on which the superstructure, on which the wheel-carrying arms are mounted, may turn, while the frame bears on the ground. These wheel-carrying arms are lowered for travel, but inspite of the improvement which is achieved, the presence of the stabilizing cross beams decreases the angles of attack and withdrawal.

It has already been proposed, so as for example to dig upright trenches in a direction perpendicular to the slope, to provide a machine having a pair of wheels mounted on wheel-carrying arms which can pivot on an end of the chassis and provided with a pair of stabilizers at the other end of the chassis, the superstructure being pivoted on said chassis by an adjusting ring. The differential control of the wheel-carrying arms and of the stabilizers permits maintaining the machine in an upright position, perpendicular to the slope. However, such a machine cannot move on the road by itself. It must be carried on a flatbed vehicle and it moves over the work place in reaction to the working equipment.

The object of the invention is to overcome these disadvantages of existing machines and to provide a self-propelled hydraulic shovel capable of moving not only on the road and on rough terrain thanks to its regulable ground clearance, but also capable of working on steeply sloped terrain, and even if desired in certain cases of digging upright trenches perpendicular to the slope of the terrain.

The invention is embodied in a public works machine such as a self-propelled hydraulic shovel, characterized in that it comprises, in combination, a lower chassis provided with two carrying wheels and raisable or removable stabilizers, such that the chassis may bear selectively on the ground simply by its carrying wheels or if desired by those wheels and its stabilizers, and a superstructure carrying the working equipment and mounted positionably on the lower chassis, a pair of carrying wheels being disposed on this superstructure, means being provided for displacing this pair of carrying wheels between a position in which they bear on the ground and a raised position.

Preferably, the carrying wheels provided on the lower chassis are adjustable relative to the lower chassis so as to regulate the ground clearance of the machine, and their regulation is such that they may be moved into a raised position in which the machine can rest on the ground on its lower chassis.

According to another preferred feature, at least one of the pair of carrying wheels of the lower chassis and of the superstructure is mounted on arms which can pivot about horizontal axes, and means are provided to control the pivoting of these arms for the adjustment or raising of the carrying wheels. According to an evidently advantageous arrangements, the horizontal pivotal axes of the arms are arranged transverse to the longitudinal axis of the machine.

According to a still further preferred embodiment, the stabilizers are mounted on opposite sides of the lower chassis so as to be able to pivot about horizontal axes, and means such as hydraulic jacks are provided to ensure their displacement between a working position in which they bear against the ground and a raised position. It will be understood however that these stabilizers may be provided on an end of the lower chassis. Preferably, these stabilizers are also mounted so as to be pivotable about vertical axes, which permits adjusting their position relative to the lower chassis, so as to impart optimum stability according to the characteristics of the terrain that is encountered.

An appropriate arrangement consists in providing carrying wheels for the lower chassis toward one end of the latter and the stabilizers toward its other end, so as to improve stability during working.

The adjustable mounting of the superstructure on the lower chassis may be ensured by means of a positioning ring, known per se in this type of machine and comprising a toothed wheel that meshes with a pinion or the like. According to another feature of the invention, means are provided to ensure the drive of this pinion, and thus the positioning ring, selectively by a positioning mechanism or by a steering wheel of the machine, such that the direction of the machine during transport or movement is ensured by articulation of the lower chassis and the superstructure, resting each on the ground through a pair of wheels, about the axis of the positioning ring. It will be understood however that these positioning or travelling movements of the machine by articulation may be obtained by other means, for example by hydraulic jacks.

The propulsion of the machine may be selectively effected by one or more hydraulic motors driving a mechanism connected kinetically to at least one of the pairs of carrying wheels, preferably to the carrying wheels on the superstructure, for example by chain and sprocket drives.

According to a possible arrangement, the positioning control of the superstructure may then be taken off this mechanism, for example by means of a disconnectible device. In such a case, the sprocket or the like of the positioning ring is also connected by means of a disconnectible device to the steering wheel of the machine. This connection may be effected by hydraulic means comprising a small steering hydraulic motor. In this case, a valve is preferably provided in the system to avoid driving the steering wheel during positioning of the superstructure when working.

In a modified embodiment, a device independent of the propulsion system of the machine is provided to ensure both the orientation of the superstructure and the control of the machine, a disconnectible device or a system of hydraulic valves being provided to operatively connect this device to a source of energy such as the hydraulic system of the machine or of the steering wheel.

Means may also be provided to ensure the positive drive of the carrying wheels of the lower chassis, for example at low speeds of the machine, for displacement at the work site. The drive of these pairs of carrying wheels may then be made selective or may be done in tandem. Preferably, the wheels provided on the superstructure are driven during movement at higher speeds, particularly on the road.

The drive of at least one of the pairs of wheels may also, if desired, be effected directly by hydraulic motors for the wheels.

It will be understood that the invention thus provides a machine capable of moving under its own power, not only on the roadway but also at the work site, when the two pairs of wheels bear on the ground. The control of the wheel-carrying arms permits regulating the clearance and thus of obtaining when travelling a lowering of the center of gravity, imparting better stability, and the ability to overcome obstacles on broken terrain, by increasing the clearance. A differential control of the wheel-carrying arms of the lower chassis and the mounting in parallel of the jacks of the wheel-carrying arms of the superstructure also permits the machine to move perpendicular to the slope of a terrain while remaining level. The control of the machine during movement is thus ensured by articulation of these two portions about the axis of the positioning ring.

During work, the pressure of the stabilizers on the ground in the desired position and the raising of the wheels of the superstructure impart to the machine high stability and permit free adjustment of the position of the superstructure, with its working device, through 360°. Under these circumstances, the differential control of the jacks of the wheel-carrying arms and of the stabilizer jacks permits here also the maintenance of the machine in a level position, even on uneven terrain, which facilitates working and makes it possible to dig vertical trenches in a direction perpendicular to the slope of the terrain.

The description which follows, taken in connection with the accompanying drawings, given in a non-limitative way, permits better understanding the invention.

Figure 1:
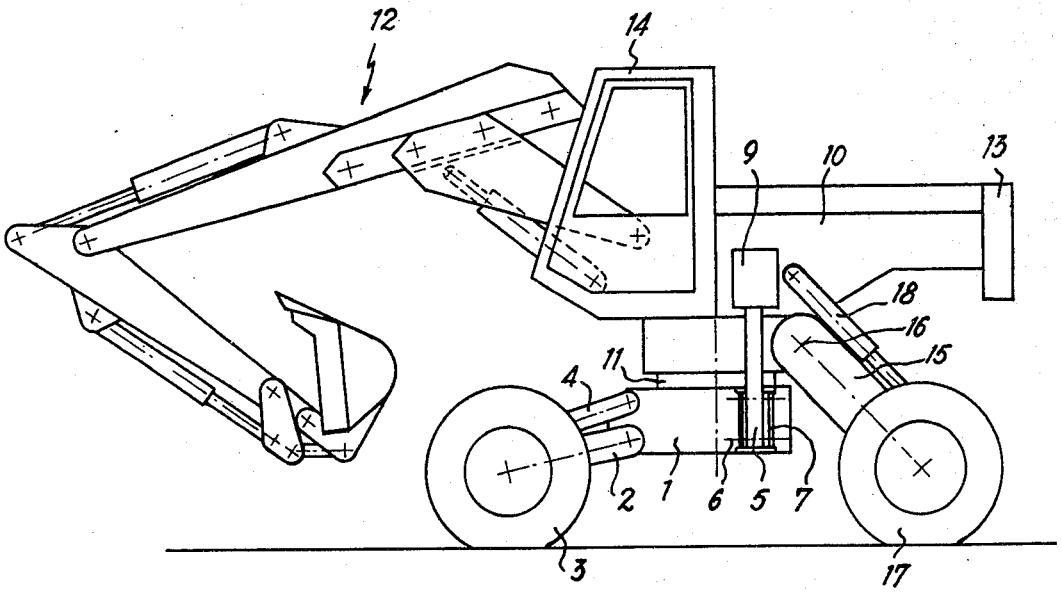
FIG. 1 is an elevational view of the self-propelled hydraulic shovel according to the invention, in its position for road travel.

The self-propelled hydraulic shovel shown in the drawings comprises a lower chassis 1 at one end of which are pivoted arms 2 which can pivot about a horizontal axis perpendicular to the longitudinal direction of the lower chassis 1 and carry front wheels 3. The control of the arms 2 is ensured by means of jacks 4 which are also articulated on the lower chassis 1.

Figure 2:
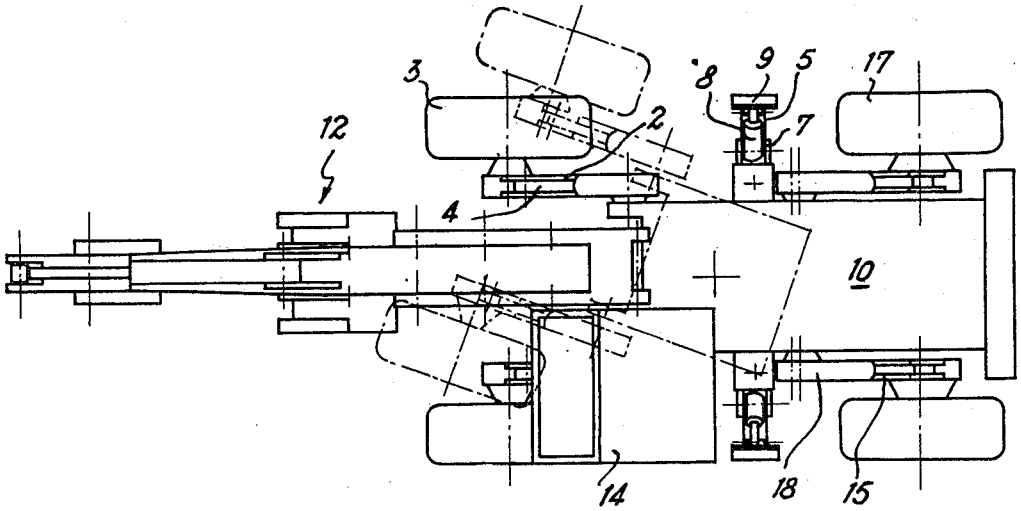
FIG. 2 is a corresponding plan view.

Stabilizers 5 are provided toward the other end of the lower chassis 1, on each of its sides. They are articulated about a horizontal axis 6 on a support 7 which itself may pivot on chassis 1 about a vertical axis. The control of the stabilizers 5 in the vertical plane is ensured by means of jacks 8 (FIG. 2).

Means (not shown) are provided on the lower chassis to ensure the positioning of stabilizers 5 about a vertical pivotal axis of the supports 7, between a position oriented substantially at 90° relative to the longitudinal axis of the lower chassis 1 and various positions of inclination about that longitudinal axis, opposite to wheels 3. Stabilizers 5 are provided with lower pads 9, in a manner known per se.

A superstructure indicated generally at 10 is mounted on lower chassis 1 so as to be able to pivot 360° by means of a positioning ring 11. This superstructure carries, toward one end, a working device which may be known per se and which is designated collectively by reference numeral 12, and toward its other end a ballast or counterweight shown at 13. A cab 14, for the driver, is provided on the superstructure beside the working device 12.

Although there is shown working equipment comprising a jib in two interconnected parts, an arm articulated on this jib and a back hoe, it will be understood that said equipment can be in whatever desired form and may also be interchangeable, without departing from the invention.

Opposite the working device 12, the superstructure 10 carries, toward its lower portion, wheel-carrying arms 15 which may pivot on the superstructure 10 about horizontal axes 16 perpendicular to the normal longitudinal axis of the machine. These arms 15 carry wheels 17 and their pivoting is controlled by means of hydraulic jacks 18. In the illustrated embodiment, the arms and the jacks are articulated on the sides of the superstructure 10. Transmission systems of known type, for example of the sprocket and chain type, are disposed in the present case within the arms 15 to ensure propulsion from the engine, the wheels 17 then comprising driven wheels. It follows however that different propulsion means, such as hydraulic motors for the wheels, may also be provided if desired.

The cylinders of jacks 18 associated with the wheels 17 are permanently in tandem connection, so that when an external force tends to raise one of the wheels 17, the other wheel falls to the same extent with a compensating movement. This communication gives to the four wheels of the machine the ability to remain in contact with the ground, no matter what the profile of the terrain.

There is shown in FIGS. 1 and 2, the position of the machine when travelling on the road. It will be seen that, under these circumstances, the arms 15 are lowered so that the machine rests on the ground, in front on wheels 3 and in the rear on wheels 17, the stabilizers 5 being raised almost vertically to the sides. The drive of the driven wheels 17 as indicated further on ensures thus the propulsion of the machine. The control of arms 2 and 15 by means of hydraulic jacks 4 and 18 permits adjusting as desired the clearance of the machine, particularly so as to give it low clearance for road travel, which also provides good stability. For travel on rough terrain, the clearance may be increased as desired by means of the jacks.

In the transport position in question, it will be understood, as is shown in broken line in FIG. 2, that it is possible to pivot through a certain angle relative to each other the lower chassis 1 and the superstructure 10 about the positioning ring 11, which permits positioning the machine by virtue of its articulated nature.

Figure 3:
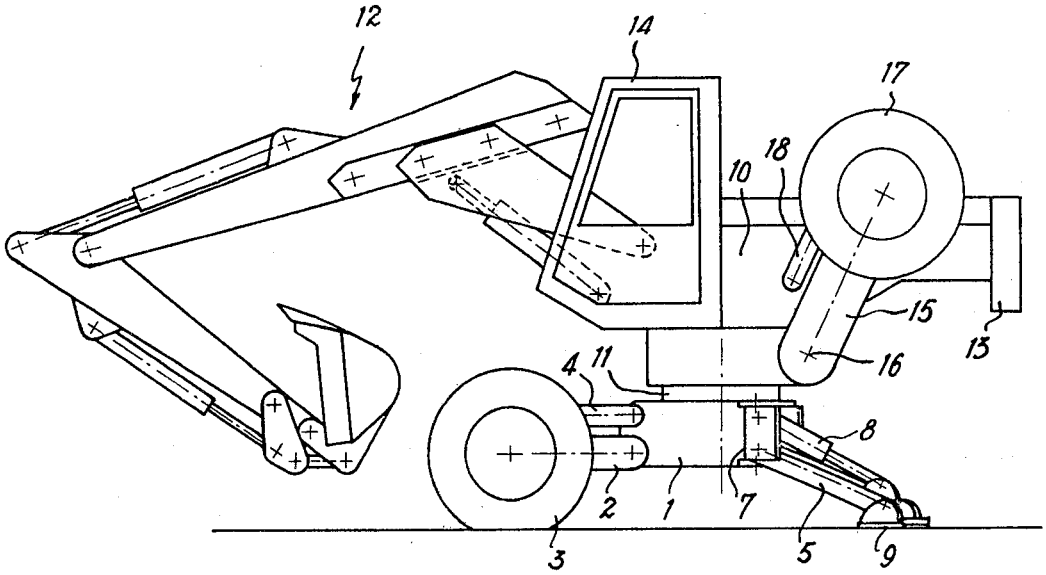
FIG. 3 is a side elevational view similar to FIG. 1, but showing the shovel in its working position.
Figure 4:
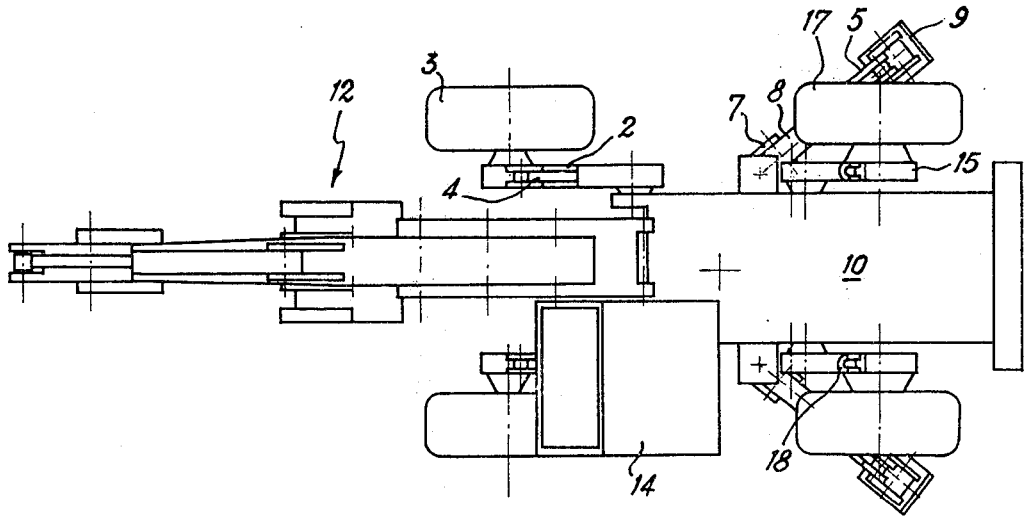
FIG. 4 is a corresponding plan view.

There is shown in FIGS. 3 and 4 the operative position of the machine. For such operation, the stabilizers 5 are swung about horizontal axes 6 by means of hydraulic jacks 8 and are positioned by supports 7 so as to have an orientation appropriate for the stability of the machine during the work operation, for example an inclination substantially at 45° with respect to the longitudinal axis of the machine as seen in FIG. 4. It will also be seen, in FIG. 3, that the arms 2 carrying the wheels 3 are controlled in such a way as substantially to reduce the ground clearance.

The wheel-carrying arms 15 are by suitable means raised so that the wheels 17 are directed substantially upwardly, these wheels then being located with their arms laterally overlying the superstructure 10.

Figure 5:
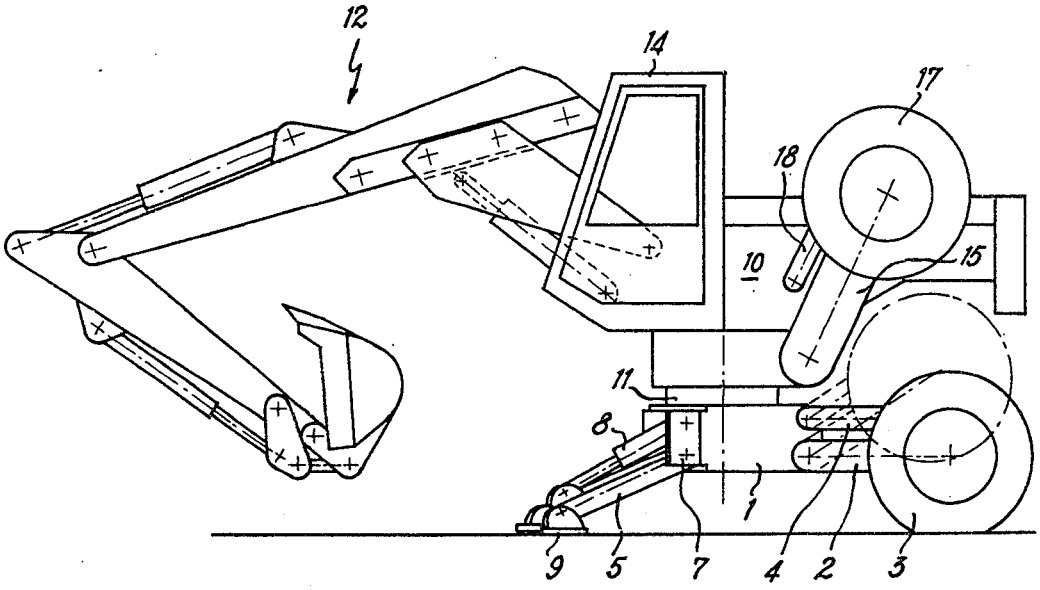
FIG. 5 is a view similar to FIG. 3, showing the preferred working position of the shovel, in which the working device is directed toward the stabilizers.
Figure 6:
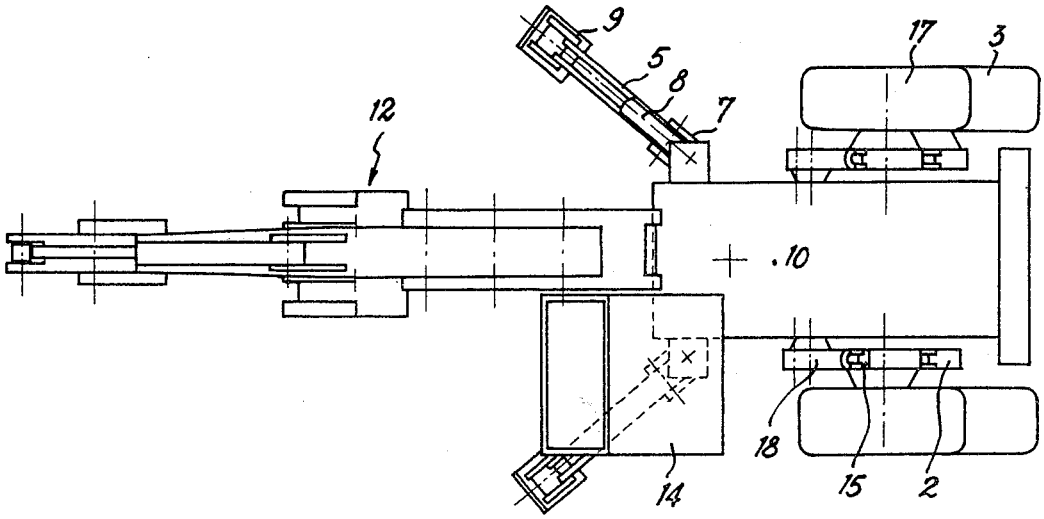
FIG. 6 is a corresponding plan view.

When the position shown in FIGS. 3 and 4 is reached, the position of the superstructure 10 is controlled so that the working equipment will be oriented toward the stabilizers 5, which provides optimum stability during working. Working may then take place in the usual way. To increase the depth of working, it is also possible to control by means of jacks 4 the raising of the arms 2, the machine then bearing against the ground with its lower chassis 1, lateral stability being again provided by the stabilizers 5, whose position in a vertical plane is correspondingly controlled. It will be seen particularly from FIG. 5 that, under these circumstances, the wheels 3 indicated in broken lines occupy a position corresponding to removal from the rear of the superstructure 10, which accordingly does not affect the position of the latter.

Figure 7:
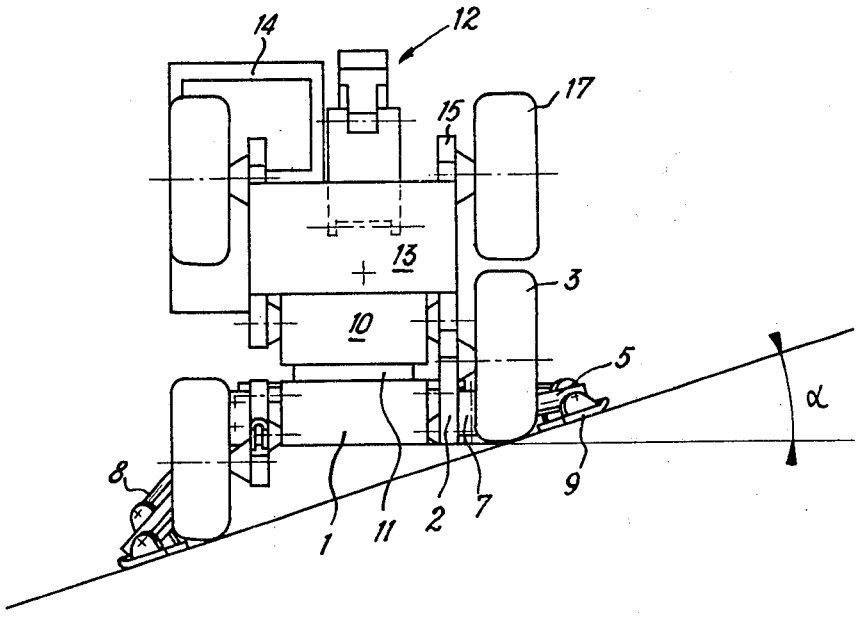
FIG. 7 is an end view showing the maching in a position which permits it to dig a vertical trench perpendicular to the direction of slope of the terrain.

There is shown in FIG. 7 the position occupied by the machine to dig for example a trench in a direction perpendicular to the slope of the terrain.

To perform such an operation, the jacks 4 for regulating the arms 2 are subjected to differential control, and the same is true for the jacks 8 of the stabilizers 5, so as to maintain the machine in the upright position shown. The stability during working is then very good and no tilting of the machine need be feared, the working device being able to operate vertically.

It will also be noted that this vertical position of the machine may be obtained by displacement of the machine inclined to the ground, by appropriate control of the arms 2 carrying the wheels 3 and by virtue of the communication existing, as previously indicated, between the jacks 16 associated with the arms 15 carrying the wheels 17.

Figure 8:
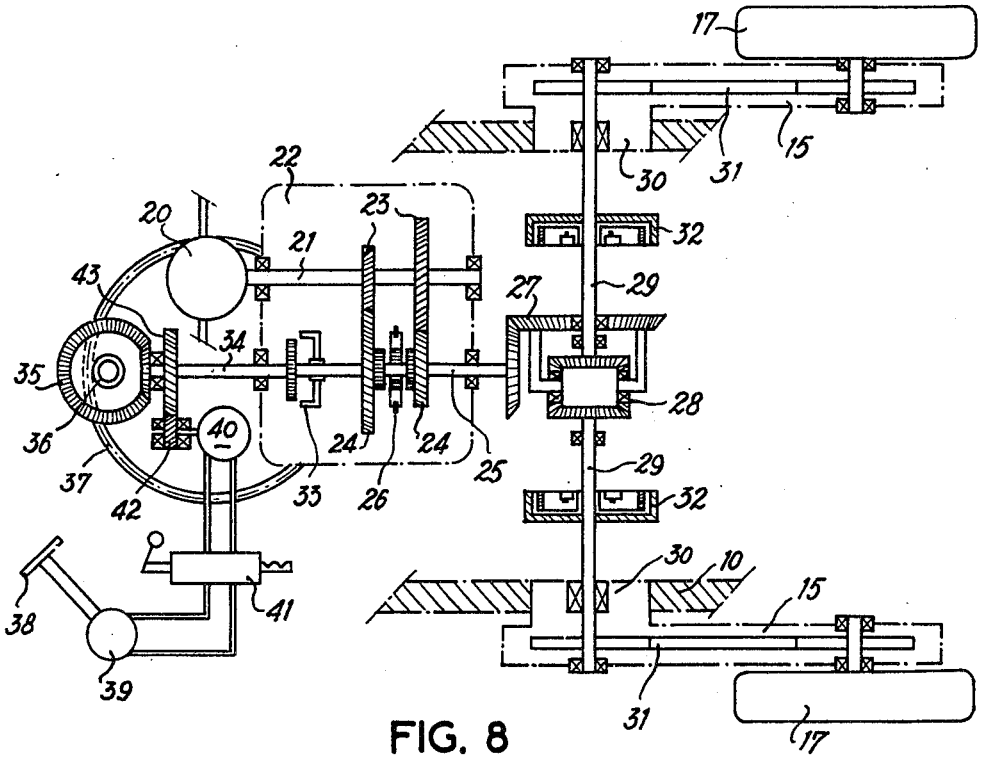
FIGS. 8 and 9 are schematic views of two embodiments of the system for propelling, positioning and controlling the hydraulic shovel.

There is shown in FIG. 8 an embodiment of a transmission system useful in the machine according to the invention to ensure drive, the orientation control of the superstructure 10 and the direction control during movement of the machine.

The system shown comprises a primary hydraulic motor 20, which is driven in any suitable way by a pump provided on the machine and whose output drives a first shaft 21 of a transmission 22. This shaft 21 carries toothed wheels 23 which engage with toothed wheels 24 mounted on a secondary shaft 25 of the transmission 22, this shaft being associated with a sliding gear 26 which permits selective engagement of one or the other of the toothed wheels 24 with shaft 25, to provide different speeds at the output of the transmission 22. This secondary shaft 25 comprises the drive shaft of the machine. It drives by bevel gears 27 a differential 28 of conventional type which, in turn, drives two opposed shafts 29 which effectuate, by means of epicycloidal gear trains 30 and a chain and sprocket transmission 31 housed in the wheel-carrying arms 15, the drive of the rear wheels 17 of the machine. Each shaft 29 has a brake 32.

The secondary shaft 25 of the transmission 22 may drive, by means of a clutch 33, another output shaft 34 which itself provides, by means of bevel gearing 35, the drive of a pinion 36 engaging with a toothed ring 37 which constitutes the active member of the positioning ring 11 of the superstructure 10 of the machine. Thus, when clutch 33 is engaged, the primary motor 20 provides for positioning of the superstructure 10 of the machine in the desired manner. The fixing of this position may be effected by brakes 32.

There is shown similarly in a schematic manner in FIG. 8 a steering wheel 38 which is associated with a device 39 for hydraulically controlling steering, ensuring the control of a small hydraulic pump 40 through a valve 41. The output shaft of this hydraulic pump carries a pinion 42 which engages with a toothed wheel 43 carried by shaft 34.

When clutch 33 is disengaged and valve 41 is in open position, the manipulation of steering wheel 38 ensures, by device 39 an auxiliary motor 40 and gearing 42, 43, the drive of shaft 34, and by the latter and the bevel gearing 35 the drive of pinion 36 and thus of the toothed ring 37, to effect an angular displacement of small amplitude of the superstructure 10 relative to the lower chassis 1, as shown in FIG. 2, thus permitting steering the machine during operation.

Valve 41 provides, when it is in its closed position, for preventing drive of the steering wheel during positioning movements of superstructure 10 through primary motor 20, as previously indicated.

Figure 9:
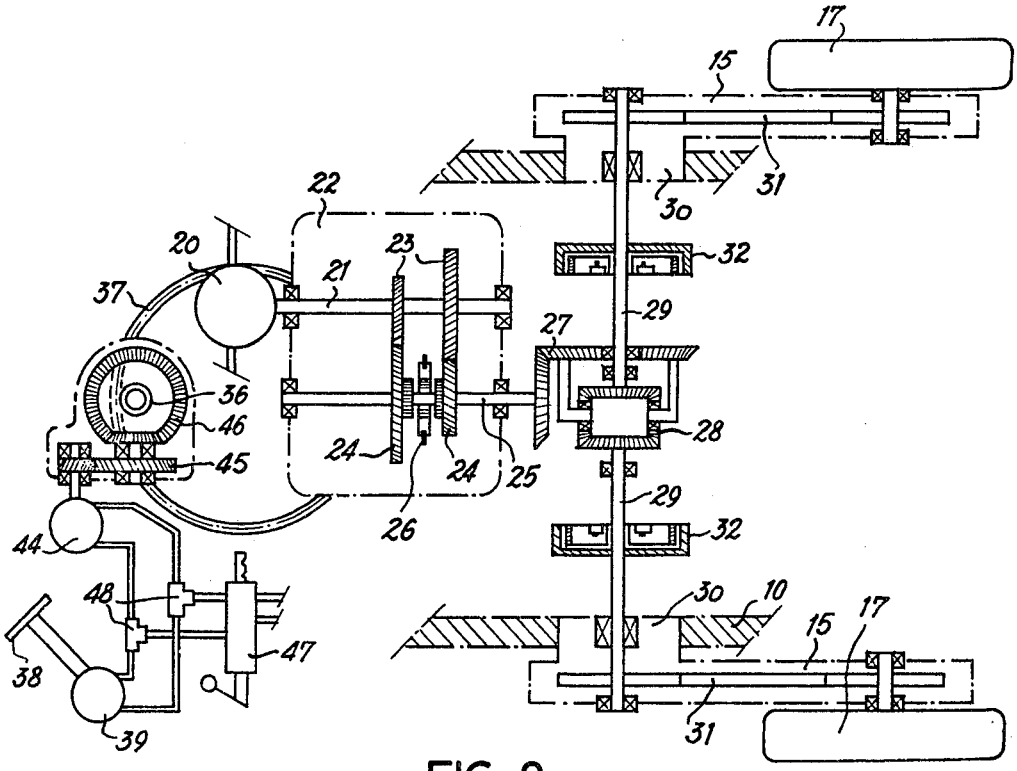

There is shown in FIG. 9, in which parts corresponding to those shown in FIG. 8 have been designated by the same reference numerals, a modification in which the positioning and the control during operation are both ensured by an auxiliary motor 44 whose output shaft drives gearing 45 which itself controls bevel gearing 46 driving pinion 36 in train with toothed positioning wheel 37. A valve 47 is provided between the circuit comprising the auxiliary motor 44 and the control system 38, 39 and the hydraulic feed of the machine, so as to ensure in this position, by means of auxiliary valves 48, the direct feeding of auxiliary motor 44, to position the superstructure 10, again isolating the steering wheel. and in the other position the placing in communication of the device 39, with the auxiliary motor 44, isolating the assembly of the hydraulic system of the machine, for controlling operation.

It will be seen that there is thus provided an articulated self-propelled hydraulic shovel which can be moved so as to have either a small clearance with the ground for road travel, or a large clearance for travel on rough ground, by control of hydraulic jacks 4 and 18 associated with wheel-carrying arms 2 and 15. The control of this hydraulic shovel is provided by relative displacement between the lower chassis 1 and the superstructure 10 by simple mechanisms, without a control bridge and in a manner providing a small steering radius, ensuring good maneuverability.

When the machine moves on inclined terrain, in a direction perpendicular to the slope, it can remain level by suitable control of jacks 4 of the forward wheels 3 and by compensation between the jacks 18 of the rear wheels 17. This level position may be kept by a combination of action of the stabilizers with the wheels, which permits a substantial correction of the inclination, making possible the digging of vertical ditches perpendicular to the slope. Finally, as previously indicated, the machine can rest on the ground through the lower chassis, which increases the depth of digging.

Modifications may be made in the described embodiments, by way of equivalent arrangements, without departing from the invention.

I claim:

1. Public works machine such as a self-propelled hydraulic shovel, characterized in that it comprises, in combination, a lower chassis (1) provided with two carrying wheels (3) and stabilizers (5) that may be raised or lowered, and a superstructure (10) carrying a working device (12) and rotatably mounted on the lower chassis (1) for rotation relative to the lower chassis about an upright axis, a pair of carrying wheels (17) being disposed on this superstructure, means (15, 18) being provided to displace this pair of carrying wheels between a position in which they bear on the ground and an elevated position, whereby the chassis may bear on the ground selectively by the first-mentioned wheels and said stabilizers or by said first-mentioned wheels and the wheels disposed on the superstructure.

2. Public works machine according to claim 1, characterized in that means (2, 4) are provided for varying the position of the carrying wheels (3) of the lower chassis (1) relative to the chassis, to regulate the ground clearance of the machine, these means being so arranged as to permit raising these carrying wheels to cause the machine to rest on the ground on its lower chassis.

3. Public works machine according to claim 1 or 2, characterized in that at least one of the pair of carrying wheels (3, 17) of the lower chassis (1) or the superstructure (10) is mounted on arms (2, 15) which can pivot about horizontal axes, and in that means such as hydraulic jacks (4, 18) or the like are provided to control the pivoting of these arms for regulating or raising the carrying wheels.

4. Public works machine according to claim 3, characterized in that the horizontal axes (16) of pivoting of the wheel-carrying arms (4, 15) are disposed transversely to the longitudinal axis of the machine.

5. Public works machine according to claim 1, characterized in that the stabilizers (5) are mounted on opposite sides of the lower chassis (1) so as to be pivotable about horizontal axes (6), and means such as hydraulic jacks (8) are provided to ensure their displacement between a working position in which they bear against the ground and a raised position.

6. Public works machine according to claim 5, characterized in that the stabilizers (5) are mounted so as to be pivotable on the lower chassis (1) about vertical axes, to adjust their position relative to the lower chassis.

7. Public works machine according to anyone of claims 1, 5 or 6, characterized in that the carrying wheels (3) of the lower chassis (1) are mounted toward one end of the chassis and the stabilizers (5) are mounted toward the other end of the chassis.

8. Public works machine according to claim 1, in which the mounting of the superstructure on the lower chassis is effected by means of a positioning ring comprising a toothed ring driven by a pinion or the like, characterized in that means are provided to ensure the drive of this pinion (36) and thus of the positioning ring (11) selectively by means of a positioning mechanism or by a steering wheel (38) of the machine, whose direction is thus ensured by articulation between the lower chassis (1) and the superstructure (10), about the positioning ring (11).

9. Public works machine according to claim 8, characterized in that it comprises a motor such as a hydraulic motor (20) driving the driven wheels (17) by means of a transmission (22) or the like and by transmissions (30, 31) housed in the wheel-carrying arms (15), and in that an output shaft (34) of the transmission (22) is connected to the control device (35, 36) of the positioning ring (11), this device being connected by disengageable means (41) to the steering wheel (38) of the machine.

10. Public works machine according to claim 8, characterized in that the device for controlling position comprises a small hydraulic motor (44) which may be connected, by valves (47, 48) or the like, to the hydraulic system of the machine or to the steering wheel (38).

* * * * *